US008656707B2

(12) United States Patent
Oohashi et al.

(10) Patent No.: US 8,656,707 B2
(45) Date of Patent: Feb. 25, 2014

(54) DIESEL ENGINE

(75) Inventors: Hiroshi Oohashi, Osaka (JP); Hiroshi Masuda, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 102 days.

(21) Appl. No.: 13/377,092

(22) PCT Filed: May 28, 2010

(86) PCT No.: PCT/JP2010/059116
§ 371 (c)(1),
(2), (4) Date: Dec. 8, 2011

(87) PCT Pub. No.: WO2010/143545
PCT Pub. Date: Dec. 16, 2010

(65) Prior Publication Data

US 2012/0079815 A1 Apr. 5, 2012

(30) Foreign Application Priority Data

Jun. 8, 2009 (JP) ..... 2009-137651

(51) Int. Cl.
*F01N 3/023* (2006.01)

(52) U.S. Cl.
USPC ..... 60/295; 60/285; 60/286; 60/297

(58) Field of Classification Search
USPC ..... 60/285, 286, 295, 297
See application file for complete search history.

(56) References Cited

U.S. PATENT DOCUMENTS

| | | | | |
|---|---|---|---|---|
| 7,104,050 | B2 * | 9/2006 | Sato et al. | 60/295 |
| 7,181,909 | B2 * | 2/2007 | Sato et al. | 60/297 |
| 7,237,379 | B2 * | 7/2007 | Nakano et al. | 60/295 |
| 7,596,942 | B2 * | 10/2009 | Colignon | 60/295 |
| 7,845,165 | B2 * | 12/2010 | Satou et al. | 60/295 |
| 2005/0217251 | A1 * | 10/2005 | Sato et al. | 60/295 |
| 2005/0217255 | A1 * | 10/2005 | Aratsuka et al. | 60/295 |
| 2005/0223700 | A1 * | 10/2005 | Abe | 60/295 |
| 2008/0163609 | A1 * | 7/2008 | Satou et al. | 60/287 |

FOREIGN PATENT DOCUMENTS

| | | | |
|---|---|---|---|
| JP | 10-159606 | A | 6/1998 |
| JP | 2000-213332 | A | 8/2000 |
| JP | 2005-282545 | A | 10/2005 |
| JP | 2006-083828 | A | 3/2006 |
| JP | 2006-316731 | A | 11/2006 |
| JP | 2009-057888 | A | 3/2009 |

OTHER PUBLICATIONS

International Search Report for PCT/JP2010/059116, Japanese Patent Office, mailed Aug. 24, 2010, 4 pages.

* cited by examiner

*Primary Examiner* — Thomas Denion
*Assistant Examiner* — Brandon Lee
(74) *Attorney, Agent, or Firm* — Sterne, Kessler, Goldstein & Fox P.L.L.C.

(57) ABSTRACT

A diesel engine is configured to be optionally set either to a low fuel consumption mode in which the amount of fuel consumption is reduced or to a low noise mode in which the noise is reduced so that a continuous regeneration mode is automatically selected when the output value of the diesel engine is greater than a predetermined value (Ptr), the estimated amount of accumulation of particulate matter collected in a DPF is greater than or equal to a predetermined value (Vtr), a forced regeneration mode is automatically selected when the output value of the diesel engine is less than the predetermined value (Ptr) and the estimated amount of accumulation of particulate matter collected in the DPF is greater than the predetermined value (Vtr) when either the continuous regeneration mode or forced regeneration mode is manually selected, control is started depending on the selected mode.

3 Claims, 4 Drawing Sheets

DIESEL ENGINE

TECHNICAL FIELD

The present invention relates to a diesel engine having an exhaust gas purifier. In more detail, the present invention relates to an art for controlling a diesel engine having an exhaust gas purifier.

BACKGROUND ART

Conventionally, a diesel particulate filter is well known which collects and oxidizes particle matters included in exhaust gas of a diesel engine so as to enable so-called continuous regeneration. An art of so-called forced regeneration is also well known in which the particle matters collected in the diesel particulate filter are oxidized forcedly by using an intake throttle controlling an intake air amount, a common rail system enabling one or a plurality times of fuel injection or the like.

However, the switching between the continuous regeneration mainly performed in a high output driving range in which the temperature of exhaust gas is high and the forced regeneration mainly performed in a low output driving range in which the temperature of exhaust gas is low is performed automatically corresponding to the driving state of the diesel engine and the accumulated amount of particle matters in the diesel particulate filter (for example, see the Patent Literature 1), whereby an operator may recognize sudden engine noise or change of output characteristics as abnormality.

Though there is a demand of reduction of fuel consumption of the diesel engine for improving the fuel economical efficiency, there is a problem in that the control for reducing the fuel consumption increases the noise of the diesel engine. On the other hand, though there is a demand of reduction of noise of the diesel engine for improving the silence, there is a problem in that the control for reducing the noise increases the fuel consumption amount of the diesel engine.

Patent Literature 1: the Japanese Patent Laid Open Gazette 2005-282545

DISCLOSURE OF INVENTION

Problems to Be Solved by the Invention

The present invention is provided for solving the above problems. The purpose of the present invention is to provide a diesel engine in which one of a low fuel consumption mode and a low noise mode can be selected as a control pattern of the diesel engine so as to improve the economical efficiency and the silence, and one of a continuous regeneration mode and a forced regeneration mode can be selected manually at the oxidization of particle matters in a diesel particulate filter so as to prevent sudden change of engine noise and output characteristics, thereby preventing an operator from recognizing them as abnormality.

Furthermore, an art is provided for displaying the mode selected manually or automatically on a visual notice means so as to prevent misunderstanding of an operator.

Means for Solving the Problems

The above-mentioned problems are solved by the following means.

According to the first aspect of the present invention, a diesel engine in which a diesel particulate filter collecting particle matters in exhaust gas is provided, comprises an electronic controller preparing a control signal following with a selected mode so as to control the diesel engine. The electronic controller can select optionally one of a low fuel consumption mode in which fuel consumption of the diesel engine is reduced and a low noise mode in which noise of the diesel engine is reduced. In the case in which an output of the diesel engine is higher than a predetermined value, when the accumulated amount of the particle matters collected in the diesel particulate filter is not less than a predetermined value, a continuous regeneration mode is selected automatically so as to make the oxidized amount of the particle matters equal to the collected amount. In the case in which an output of the diesel engine is lower than the predetermined value, when the accumulated amount of the particle matters collected in the diesel particulate filter is not less than the predetermined value, a forced regeneration mode is selected automatically so as to make the oxidized amount of the particle matters larger than the collected amount. By selecting one of the continuous regeneration mode and the forced regeneration mode manually, control corresponding to the selected mode can be performed.

According to the second aspect of the present invention, in the diesel engine of the first aspect of the present invention, the electronic controller terminates automatically the forced regeneration mode when the oxidization of the particle matters collected in the diesel particulate filter is finished, and the forced regeneration mode can be terminated manually.

According to the third aspect of the present invention, in the diesel engine of the first aspect of the present invention, the electronic controller displays the mode selected automatically or manually on a visual notice means.

Effect of the Invention

The present invention constructed as the above brings the following effects.

According to the first aspect of the present invention, one of the low fuel consumption mode and the low noise mode can be selected so as to enable the driving following with a demand of an operator, thereby improving the economical efficiency and the silence. At the oxidization of particle matters in the diesel particulate filter, one of the continuous regeneration mode and the forced regeneration mode can be selected manually so as to prevent sudden change of engine noise and output characteristics at the automatic switching of the modes, thereby preventing misunderstanding of an operator.

According to the second aspect of the present invention, by enabling the manual termination of the forced regeneration mode, sudden change of engine noise and output characteristics by the automatic termination of the forced regeneration mode, thereby preventing misunderstanding of an operator.

According to the third aspect of the present invention, an operator can recognize the mode selected automatically or manually, thereby preventing the operator from recognizing the change of engine noise and output characteristics as abnormality.

DESCRIPTION OF NOTATIONS

Figure 1:
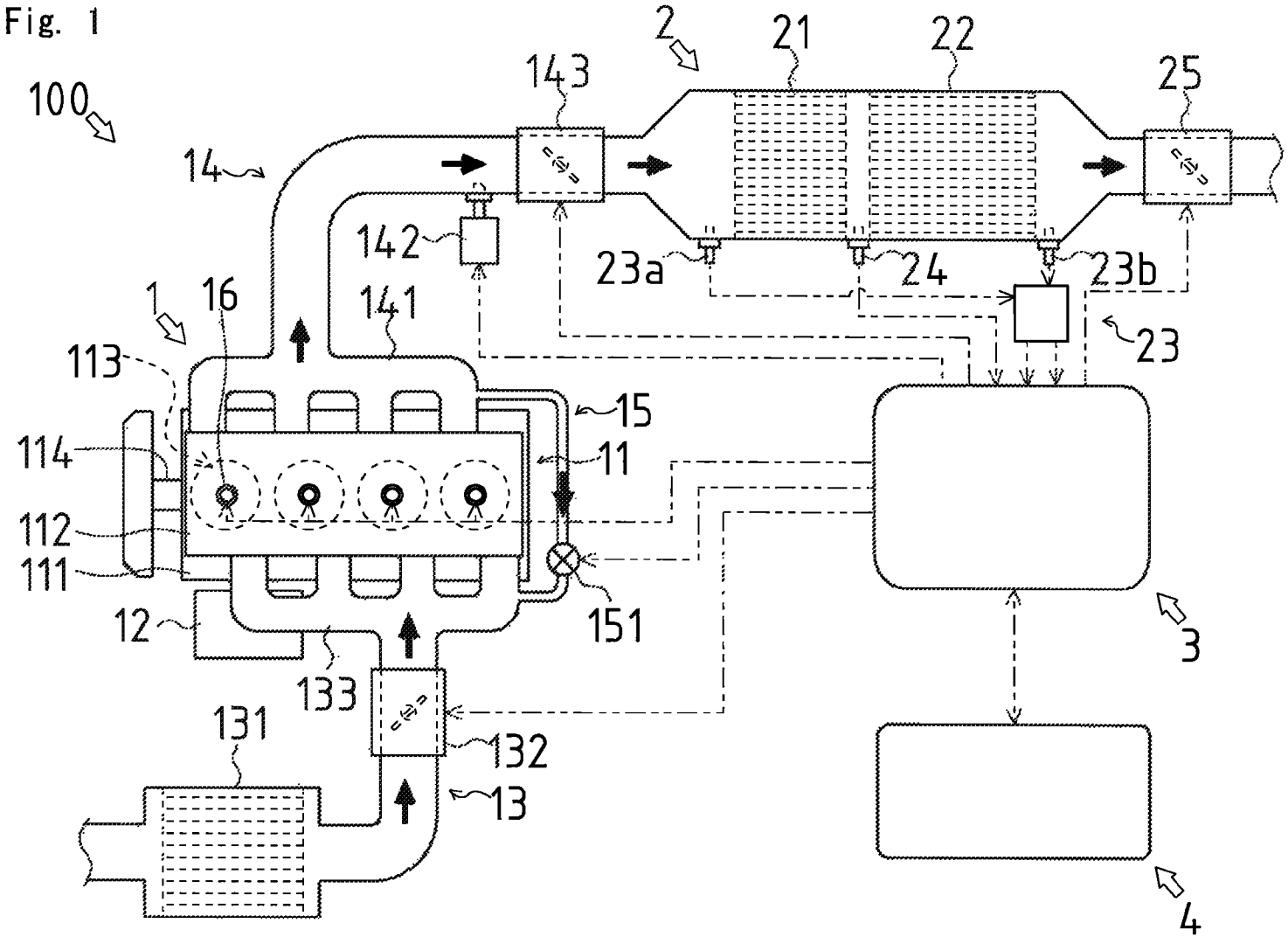
FIG. 1 It is a schematic drawing of a diesel engine according to the present invention.

100 diesel engine
1 engine body
11 engine main body
16 fuel injection nozzle
2 exhaust gas purifier
21 oxidation catalyst carrier (DOC)
22 diesel particulate filter (DPF)
23 differential pressure sensor
24 temperature sensor
3 electronic controller
4 display panel
41 selector switch
42 continuous regeneration mode button
43 forced regeneration mode button

THE BEST MODE FOR CARRYING OUT THE INVENTION

Next, explanation will be given on a mode for carrying out the present invention.

As shown in FIG. 1, a diesel engine 100 according to the present invention mainly includes an engine body 1, an exhaust gas purifier 2 and an electronic controller 3. For example, in the case that the diesel engine 100 is mounted on a working vehicle, a display panel 4 which is a visual notice means electrically connected to the electronic controller 3 is arranged near an operator's seat so as to be visible by an operator.

Firstly, explanation will be given on the construction of the engine body 1. Arrows in the drawing shows directions of flows of intake air, recirculating gas and exhaust gas.

The engine body 1 mainly includes an engine main body 11, a fuel injection pump 12, an intake passage 13, an exhaust passage 14 and an EGR device 15. In the engine body 1, fuel is supplied to compressed air so as to be burnt, whereby rotational power is obtained from expansion energy of the combustion.

The engine main body 11 mainly includes a body part having a cylinder block 111, a cylinder head 112 and the like and a moving part having pistons 113 and a crankshaft 114. In the engine main body 11, combustion chambers are constructed by cylinder holes provided in the cylinder block 111, the pistons 113 slidably provided in the cylinder holes, and the cylinder head 112 facing the pistons 113. Each of the pistons 113 is interlockingly connected to the crankshaft 114 via a connecting rod (not shown), whereby the crankshaft 114 is rotated by the sliding of the pistons 113.

The fuel injection pump 12 is driven via gears and the like by the crankshaft 114 rotatively driven, and pressingly sends fuel to fuel injection nozzles 16 by a plunger barrel (not shown) provided in the fuel injection pump 12 and a plunger slidably inserted into the plunger barrel.

Each of the fuel injection nozzles 16 is provided in the cylinder head 112 so that the tip of the fuel injection nozzles 16 is projected into the combustion chamber of the engine main body 11. By receiving a control signal from the electronic controller 3, fuel can be injected once or several times at an optional period.

The intake passage 13 is a passage which guides intake air to the combustion chamber of the engine main body 11 and mainly includes an air cleaner 131, an intake throttle 132 and an intake manifold 133 along the direction of the air flow. The intake passage 13 may include a flow rate sensor measuring an intake air amount, a temperature sensor measuring an intake air temperature and the like, but these are omitted in the drawing for simplifying it.

The air cleaner 131 filters the intake air with filter paper, a sponge or the like so as to prevent foreign matters such as dust from entering the combustion chamber.

The intake throttle 132 controls the intake air amount supplied to the combustion chamber of the engine main body 11 for example by a butterfly valve driven by a DC servomotor. Namely, by receiving a control signal from the electronic controller 3, the intake throttle 132 controls the opening degree of the butterfly valve and changes the sectional area of the intake passage 13 so as to control the intake air amount supplied to the combustion chamber.

The intake manifold 133 distributes the intake air, which has been filtered by the air cleaner 131 and controlled its amount by the intake throttle 132, to the combustion chambers equally. Since the engine body 1 according to this embodiment is a so-called straight 4-cylindered engine having four combustion chambers in series, the intake manifold 133 is formed to be branched to four passages and is fixed to the cylinder head 112.

The exhaust passage 14 guides exhaust gas discharged from the engine main body 11 to the exhaust gas purifier 2 discussed later, and mainly includes an exhaust manifold 141, an additive nozzle 142 and an exhaust throttle 143 along the direction of the exhaust flow.

The exhaust manifold 141 concentrates the exhaust gas discharged from the combustion chambers of the engine main body 11. Since the engine body 1 according to this embodiment is a straight 4-cylindered engine as mentioned above, the exhaust manifold 141 is formed so as to join the four passages into one passage.

The additive nozzle 142 is provided so as to project its tip into the inside of the exhaust passage 14, and adds fuel to the exhaust gas by receiving a control signal from the electronic controller 3. It may alternatively be constructed so as to perform so-called post injection in which fuel is injected from the fuel injection nozzles 16 at the period at which the injection does not affect the output of the engine body 1 so as to add the fuel to the exhaust gas, and the method for adding fuel as an additive is not limited.

The exhaust throttle 143 controls the exhaust pressure inside the exhaust passage 14 for example by a butterfly valve driven by a DC servomotor or a pressure diaphragm. Namely, the exhaust throttle 143 controls the opening degree of the butterfly valve and changes the sectional area of the exhaust passage 14 so as to control the exhaust pressure.

The EGR device 15 returns a part of the exhaust gas as recirculation gas from the exhaust manifold 141 to the intake manifold 133. Accordingly, oxygen concentration in the intake air supplied to the combustion chambers can be reduced so as to suppress generation of nitrogen oxides which are substances of environmental concern. An EGR valve 151 is disposed in a recirculation gas passage of the EGR device 15.

The EGR valve 151 controls the amount of the recirculation gas returned to the intake manifold 133 with a valve body driven by a DC servomotor or a step motor. Namely, the EGR valve 151 controls the opening degree of the valve body and changes the sectional area of the recirculation gas passage by receiving a control signal from the electronic controller 3 so as to control the amount of the recirculation gas.

Next, explanation will be given on the construction of the exhaust gas purifier 2 in detail.

The exhaust gas purifier 2 removes particle matters in the exhaust gas and mainly includes an oxidation catalyst carrier (hereinafter, referred to as "DOC") 21, a diesel particulate filter (hereinafter, referred to as "DPF") 22, a differential pressure sensor 23 and a temperature sensor 24. The DOC 21 and the DPF 22 are provided inside a cylindrical exhaust passage, and the DOC 21 is arranged at the upstream side and the DPF 22 is arranged at the downstream side.

The DOC 21 oxidizes and removes CO (carbon monoxide) and HC (carbon hydride) included in the exhaust gas and SOF (soluble organic fraction) constituting the particle matters. The DOC 21 oxidizes NO (nitrogen monoxide) and changes it to $NO_2$ (nitrogen dioxide), and oxidizes the fuel added from the additive nozzle 142 to the exhaust gas, whereby the exhaust gas temperature is increased.

The DPF 22 collects the particle matters mainly including soot so as to filter the exhaust gas, and oxidizes the collected particle matters so as to remove them. In this embodiment, the DPF 22 whose substrate is silicon carbide is employed, and the particle matters included in the exhaust gas are collected at the time at which the exhaust gas passes through minute holes formed in the DPF 22. The particle matters collected as mentioned above are oxidized by oxygen in the exhaust gas and $NO_2$ generated in the DOC 21 on the condition of the temperature at which the exhaust gas can progress the oxidization reaction.

Namely, since the DPF 22 can oxidize the particle matters only at the state at which the exhaust gas temperature is high, it is necessary to control continuous regeneration in which the particle matters are oxidized naturally when the exhaust gas temperature is high and forced regeneration in which the exhaust gas temperature is forcedly increased so as to oxidize the particle matters when the exhaust gas temperature is low following with the driving state of the engine body 1 and the like.

The differential pressure sensor 23 includes an upstream sensor 23*a* arranged at the upstream side of the DOC 21 and a downstream sensor 23*b* arranged at the downstream side of the DPF 22, and detects differential pressure from measured values from the sensors. Then, the differential pressure sensor 23 transmits momently the detection results to the electronic controller 3, and the electronic controller 3 can assume the accumulation amount of the particle matters in the DPF 22 by grasping the change with time of the differential pressure.

The tip of the temperature sensor 24 is arranged between the DOC 21 and the DPF 22, and the temperature sensor 24 measures the temperature of the exhaust gas introduced into the DPF 22. Then, the temperature sensor 24 transmits momently the detection results to the electronic controller 3, and the electronic controller 3 generates the optimum control signal based on feedback control with the exhaust gas temperature.

In the diesel engine 100 according to this embodiment, an exhaust throttle 25 is arranged at the downstream side of the exhaust gas purifier 2 so as to control the exhaust pressure generated inside the exhaust gas purifier 2.

Next, explanation will be given on the construction of the electronic controller 3 in detail.

The electronic controller 3 is connected electrically to the differential pressure sensor 23 and the temperature sensor 24 provided in the exhaust gas purifier 2 and an engine output set means such as an accelerator pedal (not shown), and generates the control signal based on the electric signals from the connected members and transmits the control signal to the fuel injection nozzles 16 and the like. The electronic controller 3 is connected electrically to the display panel 4 which is the visual notice means arranged near the operator's seat or the like and can transmit the electric signal bidirectionally.

In the electronic controller 3, control maps such as a fuel injection map, an EGR map, an intake throttle map and an exhaust throttle map are stored so as to control the engine body 1 following with a request of an operator and to perform the control necessary for the continuous regeneration and the forced regeneration of the DPF 22. These maps are set for each of modes discussed later, and maps to be used is changed corresponding to the mode selected automatically or manually.

In each of the maps such as the fuel injection map, for example for securing engine rotation speed or torque required by an operator or for securing exhaust gas temperature required for oxidization of the particle matters, the optimum control factor found previously by tests is stored. The electronic controller 3 calls the control factor from each map and makes a control signal so as to control the diesel engine 100 optimally.

The modes which can be realized by the electronic controller 3 are a low fuel consumption mode in which the control is performed for reducing fuel consumption, a low noise mode in which the control is performed for reducing noise, a continuous regeneration mode in which the control is performed for making the oxidized amount of the particle matters in the DPF 22 equal to the collected amount thereof, and a forced regeneration mode in which the control is performed for making the oxidized amount of the particle matters in the DPF 22 larger than the collected amount thereof. Each of the low fuel consumption mode and the low noise mode can be selected optionally by an operator. Each of the continuous regeneration mode and the forced regeneration mode can be selected automatically corresponding to the driving state of the diesel engine 100 or the like or manually by an operator in case of the oxidization of the particle matters in the DPF 22.

The low fuel consumption mode is a control pattern in which high combustion pressure is generated at a predetermined time in the combustion chamber of the engine main body 11. For employing the maps for the low fuel consumption mode which realize the control pattern, the fuel consumption amount of the diesel engine 100 can be reduced.

Concretely, firstly, the intake throttle 132 is opened fully so as to maximize the amount of the intake air supplied to the combustion chamber, and the exhaust throttles 143 and 25 are opened maximally so as to discharge the exhaust gas smoothly. The fuel of the amount corresponding to engine rotational speed and torque required by an operator is supplied from the fuel injection nozzles 16 to the combustion chamber at the optimum time, whereby high combustion pressure is obtained in the combustion chamber.

Accordingly, the high combustion pressure is secured at the optimum time in the combustion chamber so as to obtain the rotational power, whereby the fuel consumption amount of the diesel engine 100 can be reduced. On the other hand, since the consumption noise is increased following with the increase of the combustion pressure, the noise generated by the diesel engine 100 is increased.

The low noise mode is a control pattern in which the combustion pressure in the combustion chamber of the engine main body 11 is lower than that of the low fuel consumption mode and is maintained for longer time than that of the low fuel consumption mode. For employing the maps for the low noise mode which realize the control pattern, the noise of the diesel engine 100 can be reduced.

Concretely, firstly, the intake throttle 132 is opened fully so as to maximize the amount of the intake air supplied to the combustion chamber, and the exhaust throttles 143 and 25 are opened maximally so as to discharge the exhaust gas smoothly. The fuel of the amount corresponding to engine rotational speed and torque required by an operator is divided into several times and supplied from the fuel injection nozzles 16 to the combustion chamber at the optimum time, whereby comparative lower combustion pressure is obtained for comparative longer time.

Accordingly, comparative lower combustion for comparative longer time is secured in the combustion chamber so as to soften the change of the combustion pressure, whereby the combustion noise is suppressed so as to reduce the noise generated by the diesel engine 100. On the other hand, since the combustion pressure in the combustion chamber is lower than that of the low fuel consumption mode, the fuel consumption amount of the diesel engine 100 is increased.

Figure 2:
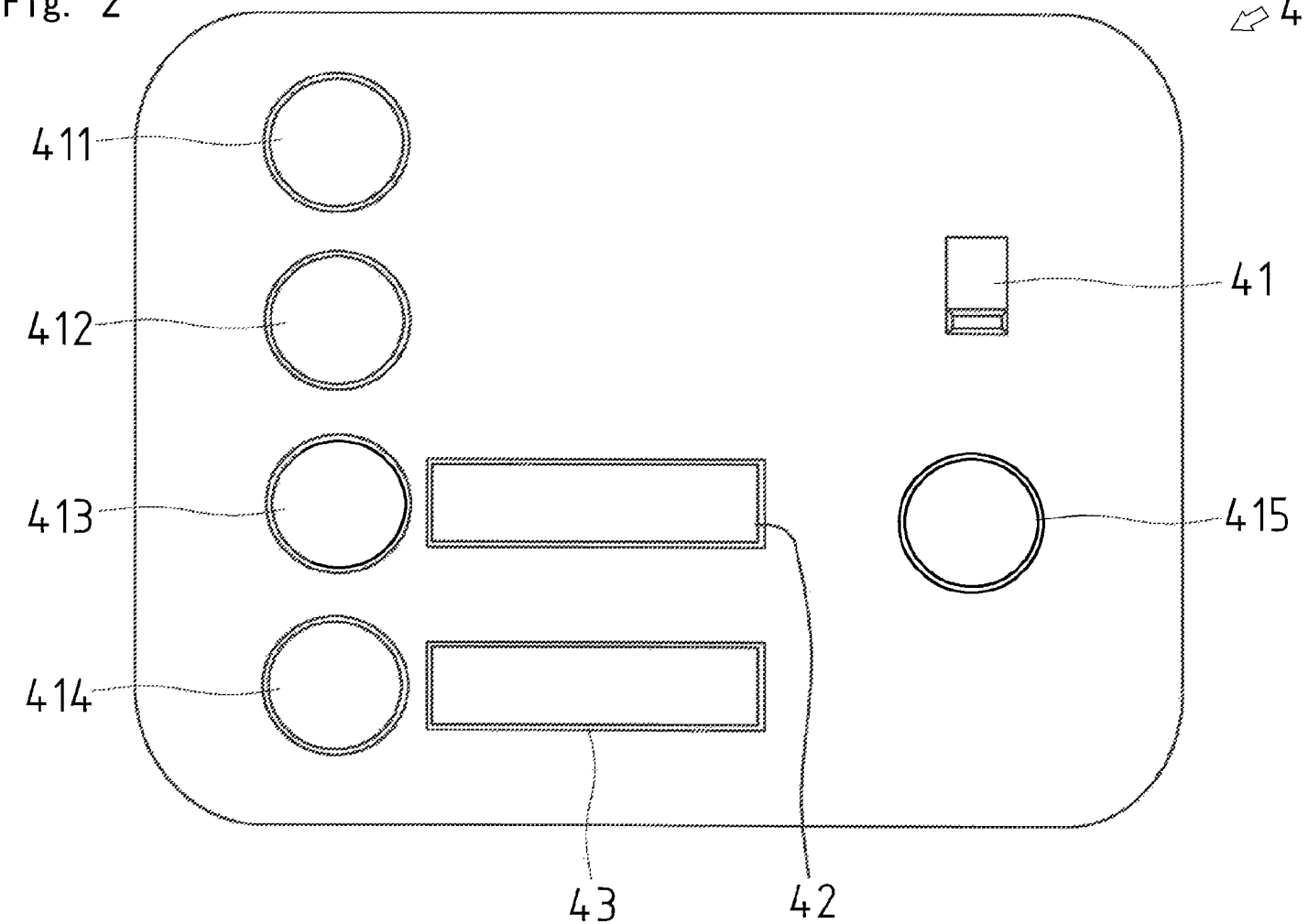
FIG. 2 It is a drawing of a display panel of the diesel engine according to the present invention.

In the diesel engine 100 according to this embodiment, as shown in FIG. 2, by operating a selector switch 41 provided in the display panel 4, one of the low fuel consumption mode and the low noise mode can be selected optionally. Accordingly, the drive corresponding to require of an operator can be performed, whereby the economical efficiency and the silence can be improved. A low fuel consumption mode lamp 411 is lightened following with the selection of the low fuel consumption mode and a low noise mode lamp 412 is lightened following with the selection of the low noise mode, whereby an operator can grasp the selected mode immediately.

When the particle matters more than a predetermined value are judged to be accumulated in the DPF 22 based on the differential pressure sensor 23 provided in the exhaust gas purifier 2, the electronic controller 3 selects automatically the continuous regeneration mode or the forced regeneration mode.

Figure 3:
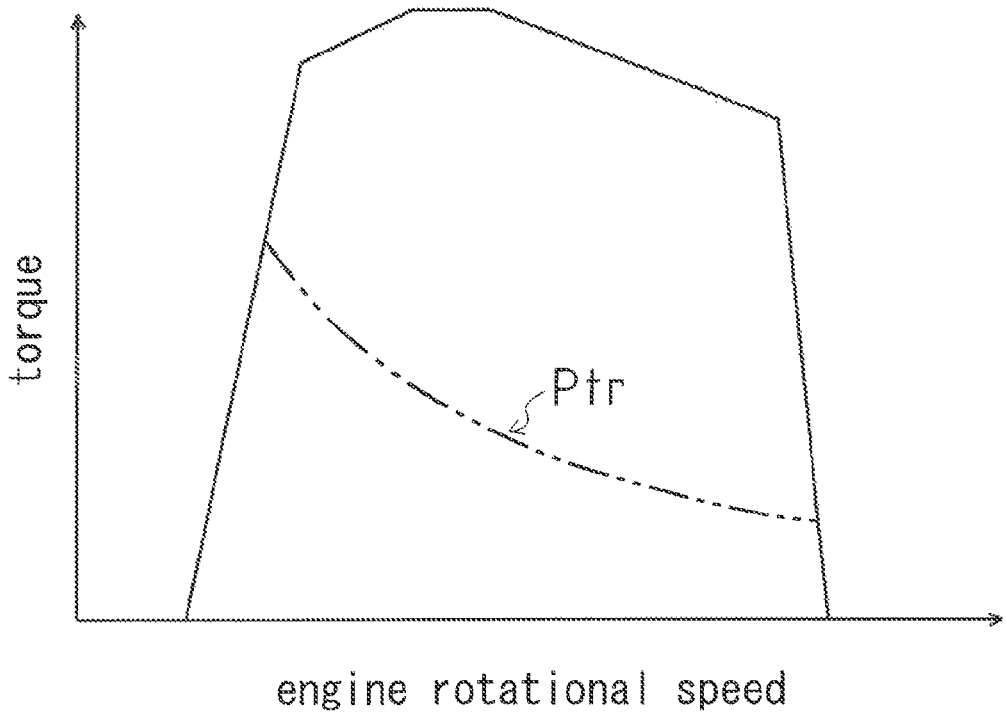
FIG. 3 It is a diagram of a continuous regeneration mode region and a forced regeneration mode region of the diesel engine according to the present invention.

The continuous regeneration mode is a control pattern in which the oxidized amount of the particle matters in the DPF 22 is equal to the collected amount thereof. As shown in FIG. 3, when the output of the diesel engine 100 is larger than a predetermined value (hereinafter, referred to as "output threshold value") Ptr (upper right side in the diagram) and the accumulated amount of the particle matters collected in the DPF 22 is not less than a predetermined value (hereinafter, referred to as "accumulation threshold value") Vtr, the control is performed with the maps for the continuous regeneration mode.

Concretely, firstly, the intake throttle 132 is opened fully so as to maximize the amount of the intake air supplied to the combustion chamber, and the exhaust throttles 143 and 25 are opened maximally so as to discharge the exhaust gas smoothly. The amount of injected fuel corresponding to engine rotational speed and torque required by an operator is divided into several times or not divided and supplied from the fuel injection nozzles 16 to the combustion chamber at the optimum time, whereby the collected amount of the particle matters in the DPF 22 is balanced with the oxidized amount of the particle matters in the DPF 22.

In detail, the combustion process in the combustion chamber is divided into former combustion which does not affect much on the generation of the particle matters and latter combustion which affects much on the generation of the particle matters. Accordingly, by controlling the ratio of the former combustion to the latter combustion for example by controlling the fuel injection time, the collected amount of the particle matters can be balanced with the oxidized amount of the particle matters in the DPF 22. Since the speed of oxidization of the particle matters in the DPF 22 changes corresponding to the temperature of the exhaust gas, the feedback control is performed based on the detection results of the temperature sensor 24.

Accordingly, in the continuous regeneration mode, the collected amount of the particle matters can be balanced with the oxidized amount of the particle matters in the DPF 22, whereby the diesel engine 100 can be driven without the forced regeneration.

The forced regeneration mode is a control pattern in which the oxidized amount of the particle matters in the DPF 22 is larger than the collected amount thereof. As shown in FIG. 3, when the output of the diesel engine 100 is lower than the output threshold value Ptr (lower left side in the diagram) and the accumulated amount of the particle matters collected in the DPF 22 is not less than the accumulation threshold value Vtr, the control is performed with the maps for the forced regeneration mode.

Concretely, firstly, the intake throttle 132 is closed to a predetermined opening degree so as to restrict the amount of the intake air supplied to the combustion chamber, and the exhaust throttles 143 and 25 are closed to a predetermined opening degree so as to suppress the discharge of the exhaust gas. The amount of fuel corresponding to engine rotational speed and torque required by an operator is divided into several times and supplied from the fuel injection nozzles 16 to the combustion chamber at the optimum time, and fuel is added to the exhaust gas by the additive nozzle 142. Accordingly, the oxidized amount of the particle matters in the DPF 22 is larger than the collected amount of the particle matters in the DPF 22.

In detail, by restricting the intake air amount supplied to the combustion chamber of the engine main body 11 and controlling the fuel injection time, the temperature of the exhaust gas can be increased about the supplied fuel. Furthermore, by oxidizing the fuel added from the additive nozzle 142 to the exhaust gas by the DOC 21, the exhaust gas temperature can be increased forcedly. Accordingly, the oxidized amount of the particle matters in the DPF 22 can be made larger than the collected amount of the particle matters in the DPF 22.

Accordingly, in the forced regeneration mode, the oxidized amount of the particle matters in the DPF 22 can be made larger than the collected amount of the particle matters in the DPF 22, whereby the particle matters accumulated in the DPF 22 can be reduced.

In the diesel engine 100 according to this embodiment, normally, the continuous regeneration mode or the forced regeneration mode is selected automatically corresponding to the driving state of the diesel engine 100 or the like. However, for enabling an operator to select one of the modes manually optionally, a continuous regeneration mode button 42 and a forced regeneration mode button 43 are provided in the display panel 4 (see FIG. 2). Accordingly, one of the modes can be selected previously, whereby sudden engine noise and change of the output characteristics caused by the automatic switching of the modes can be prevented so as to prevent an operator from recognizing them as abnormality. A continuous regeneration mode lamp 413 is lightened following with the selection of the continuous regeneration mode and a forced regeneration mode lamp 414 is lightened following with the selection of the forced regeneration mode, whereby an operator can grasp the selected mode immediately. Furthermore, a regeneration lamp 415 is lightened at each of the modes so as to indicate that the particle matters are oxidized.

When the oxidization of the particle matters in the DPF 22 by the control of the forced regeneration mode, the low fuel consumption mode or the low noise mode is selected automatically and the engine noise and the output characteristics may be changed. However, in the diesel engine 100 according to this embodiment, by pushing the forced regeneration mode button 43 when the forced regeneration is performed by automatic or manual selection, the forced regeneration can be finished optionally.

Accordingly, an operator can terminate the forced regeneration optionally, whereby the change of the engine noise and the output characteristics caused by the automatic switching of the modes can be prevented.

Explanation will be given on steps for selecting the modes mentioned above in the above construction in detail referring to FIG. 4.

Figure 4:
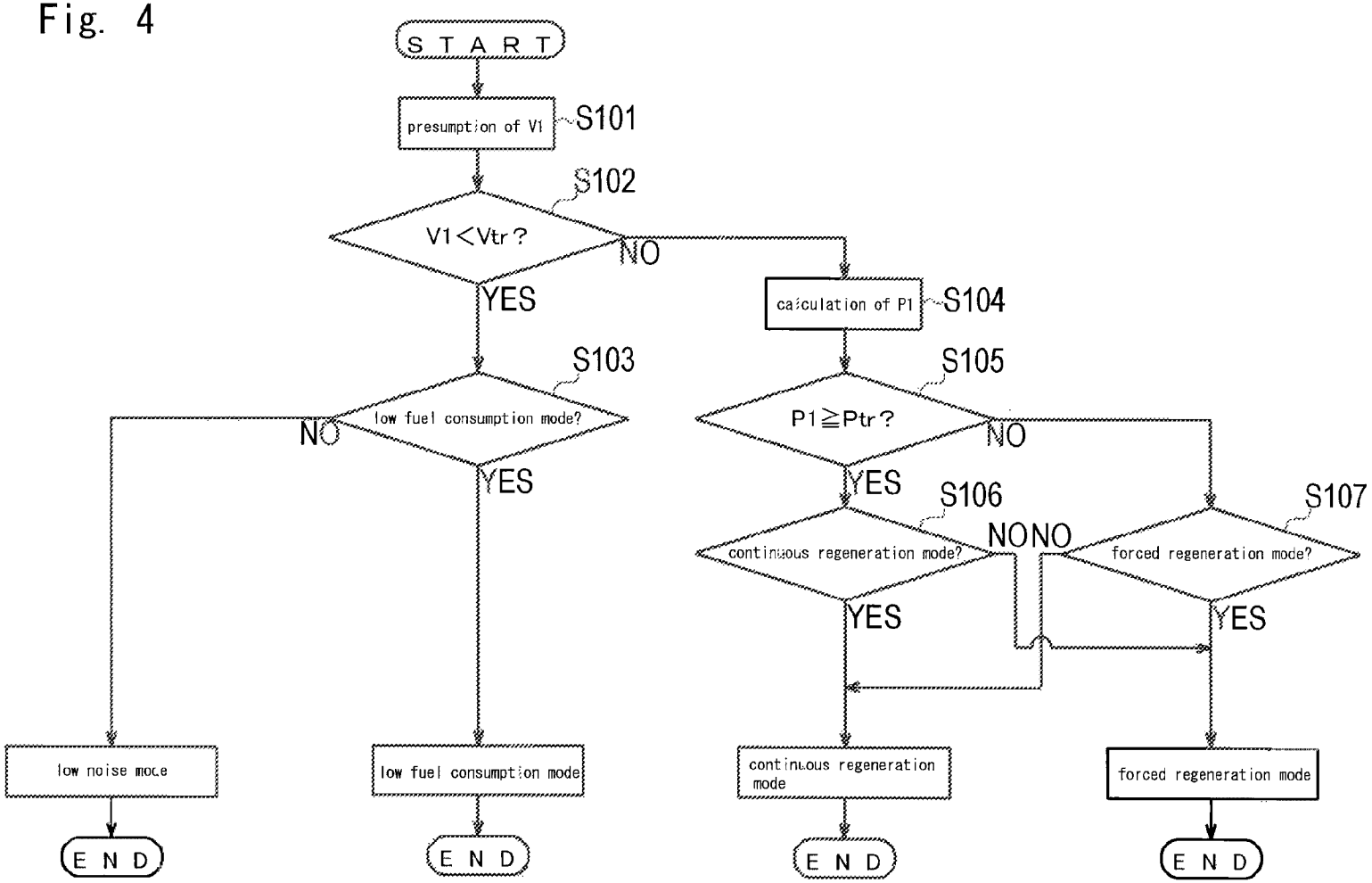
FIG. 4 It is a flow chart of selection of modes of the diesel engine according to the present invention.

FIG. 4 is a flow chart of the steps for selecting each of the modes. The electronic controller 3 confirms whether the selected mode is proper or not for every predetermined time and renews the mode when the selected mode is judged to be not proper.

At a step S101, the electronic controller 3 presumes an accumulated amount V1 of the particle matters in the DPF 22 based on the detection results of the differential pressure sensor 23. At this time, by the revision referring to drive history stored in the electronic controller 3, the accumulated amount V1 can be presumed with high accuracy.

At a step S102, the accumulation threshold value Vtr found previously by tests and stored in the electronic controller 3 is compared with the accumulated amount V1 presumed at the step S101. When the accumulated amount V1 presumed at the step S101 is judged to be smaller than the accumulation threshold value Vtr, the control shifts to a step S103. The accumulation threshold value Vtr is determined by the tests based on the kinds and size of the substrate of the DPF 22, the driving state at which the diesel engine 100 is used abundantly, and the like, and is not limited to a concrete value.

At the step S103, the electronic controller 3 judges whether an operator requires the low fuel consumption mode or the low noise mode. Concretely, it is judged whether the selector switch 41 provided in the display panel 4 indicates the low fuel consumption mode or the low noise mode.

For example, when an operator operates the selector switch 41 to the side of the low fuel consumption mode so as to require the driving pattern of the low fuel consumption mode, the electronic controller 3 performs the control with the maps for the low fuel consumption mode. For example, when an operator operates the selector switch 41 to the side of the low noise mode so as to require the driving pattern of the low noise mode, the electronic controller 3 performs the control with the maps for the low noise mode.

On the other hand, when the accumulated amount V1 presumed at the step S101 is judged to be not less than the accumulation threshold value Vtr at the step S102, the control shifts to a step S104. At the step S104, an output value P1 of the engine body 1 is calculated based on the engine rotational speed, the injection amount of the fuel supplied to the combustion chamber, and the like. Namely, the output value P1 of the engine body 1 is calculated by referring to the engine rotational speed detected by an engine rotation sensor and control signal of fuel injection amount to the fuel injection nozzles 16.

At a step S105, the output threshold value Ptr found previously by tests and stored in the electronic controller 3 is compared with the output value P1 calculated at the step S104. When the output value P1 calculated at the step S104 is judged not less than the output threshold value Ptr, the control shifts to a step S106. The output threshold value Ptr is the output value of the engine body 1 at which the exhaust gas temperature enough for the DPF 22 to perform the continuous regeneration can be secured, and is changed corresponding to the distance between the engine body 1 and the exhaust gas purifier 2, whereby the output threshold value Ptr is not limited to a concrete value.

At the step S106, the electronic controller 3 judges whether an operator requires the continuous regeneration mode or the forced regeneration mode. When the output value P1 of the engine body 1 is not less than the output threshold value Ptr, the exhaust gas temperature is high, whereby the continuous regeneration mode is automatically selected normally. However, for example, when the operator performs delicate work, by selecting the forced regeneration mode so as to finish previously the oxidization of the particle matters in the DPF 22, the change of the engine noise and the output characteristics caused by the automatic switching of the modes can be prevented.

Accordingly, in the case in which the continuous regeneration mode is automatically selected normally, for example, when the operator pushes the forced regeneration mode button 43 so as to require the driving pattern of the forced regeneration mode, the control with the maps for the forced regeneration mode can be performed.

On the other hand, at the step S105, when the output value P1 calculated at the step S104 is judged less than the output threshold value Ptr, the control shifts to a step S107. At the step S107, the electronic controller 3 judges whether an operator requires the continuous regeneration mode or the forced regeneration mode. When the output value P1 of the engine body 1 is less than the output threshold value Ptr, the exhaust gas temperature is low, whereby the forced regeneration mode is automatically selected normally. However, for example, when the operator performs delicate work, by selecting the continuous regeneration mode, the change of the engine noise and the output characteristics caused by the automatic switching of the modes can be prevented.

Accordingly, in the case in which the forced regeneration mode is automatically selected normally, for example, when the operator pushes the continuous regeneration mode button 42 so as to require the driving pattern of the continuous regeneration mode, the control with the maps for the continuous regeneration mode can be performed.

INDUSTRIAL APPLICABILITY

The present invention can be employed for a diesel engine having an exhaust gas purifier.

The invention claimed is:

1. A diesel engine in which a diesel particulate filter collecting particle matters in exhaust gas is provided, comprising:

an electronic controller preparing a control signal to perform a selected mode so as to control the diesel engine, wherein the electronic controller is configured to:

select one of a low fuel consumption mode in which fuel consumption of the diesel engine is reduced by generating high combustion pressure at a predetermined timing in a combustion chamber of an engine main body and a low noise mode in which noise of the diesel engine is reduced by generating a comparatively lower combustion pressure for a comparatively longer time than those of the low fuel consumption mode in the combustion chamber of the engine main body, automatically select a continuous regeneration mode, although the low fuel consumption mode or the low noise mode has been selected, when an output of the diesel engine is higher than a predetermined value, such that when the accumulated amount of the particle matters collected in the diesel particulate filter is not less than a predetermined value, the continuous regeneration mode is selected automatically so as to make the oxidized amount of the particle matters equal to the collected amount, automatically select a forced regeneration mode, although the low fuel consumption mode or the low noise mode has been selected, when an output of the diesel engine is lower than the predetermined value, such that when the accumulated amount of the particle maters collected in the diesel particulate filter is not less than the predetermined value, the forced regeneration mode is selected automatically so as to make the oxidized amount of the particle matters larger than the collected amount, and perform the continuous regeneration mode or the forced regeneration mode when the respective mode is selected manually.

2. The diesel engine according to claim 1, wherein the electronic controller is configured to terminate automatically the forced regeneration mode when the oxidization of the particle matters collected in the diesel particulate filter is finished, and terminate the forced regeneration mode upon manual selection.

3. The diesel engine according to claim 1, wherein the electronic controller displays the mode selected automatically or manually on a display panel.

* * * * *